United States Patent [19]

Breaux et al.

[11] Patent Number: 4,648,143

[45] Date of Patent: Mar. 10, 1987

[54] SUNBATHING APPARATUS HAVING WATER SPRAY COOLING MEANS

[76] Inventors: Connie C. Breaux; Roddy P. Breaux, both of P.O. Box 59, Gheens, La. 70355

[21] Appl. No.: 740,879

[22] Filed: Jun. 3, 1985

[51] Int. Cl.[4] ..... A47C 21/04; A47K 3/22; B05B 17/00

[52] U.S. Cl. ..... 5/417; 5/421; 4/615; 239/289

[58] Field of Search ..... 5/420, 421, 417; 239/289; 4/615, 616, 617, 618, 567, 568, 569, 570

[56] References Cited

U.S. PATENT DOCUMENTS

| | | | |
|---|---|---|---|
| 920,575 | 5/1909 | Ike | 4/569 |
| 3,625,434 | 12/1971 | Kitover | 128/372 |
| 3,688,775 | 9/1972 | Raymann | 239/289 |
| 3,997,927 | 12/1976 | Culligan | 5/420 |
| 4,151,618 | 5/1979 | Carpenter | 5/421 |

FOREIGN PATENT DOCUMENTS

| | | | |
|---|---|---|---|
| 1209228 | 2/1960 | France | 5/420 |
| 2431271 | 3/1980 | France | 5/420 |

*Primary Examiner*—Alexander Grosz
*Attorney, Agent, or Firm*—George A. Bode

[57] ABSTRACT

A sunbathing apparatus comprising a generally rectangular flexible sheet having an elongated flexible water conduit integrally attached to a marginal side edge thereof, the conduit and the marginal side edge having a plurality of spaced concentric perforations therealong, the perforations positioned toward the upper surface of the sheet member, and a valve for coupling the conduit to an operative supply of water and controlling the rate of flow of water provided the conduit whereby water flowing into the conduit and out through the perforations is directed upwardly and inwardly of the marginal side edge of the sheet member so as to direct a fine spray of water onto the upper surface of the sheet member.

4 Claims, 5 Drawing Figures

SUNBATHING APPARATUS HAVING WATER SPRAY COOLING MEANS

BACKGROUND OF THE INVENTION

1. Field of the Invention

The present invention relates to sunbathing apparatus having water spray cooling means. More particularly, the present invention relates to sunbathing apparatus providing for a flexible mat or sheet integrally connected at one of its marginal side edges with a perforated conduit connected to a hose through a valve so that water flowing into the conduit and out the perforations are directed upwardly onto the surface of the mat for cooling a person lying in the sun on the mat.

2. General Background

People who wish to sunbathe in order to produce a tan or other beneficial effects are often exposed to the unwanted side effect of overheating. Therefore, there is a need to have some cooling effect while maintaining exposure to the sun. Continuously sprinkling the person with water produces a cooling effect and also assists in concentrating the rays of the sun.

Several attempts have been made in the prior art to develop a system for cooling a sunbather with a water spray cooling means.

U.S. Pat. No. 3,997,927 entitled "Sunbathing Mat Assembly" issued to R. L. Culligan and discloses a mat of flexible material to be laid on the ground on a slope with a perforated conduit connected to a garden hose running along the upper edge of the mat so that water running through the hose trickles through the perforated conduit and flows down the mat and cools the lower side of the body. A control valve determines the rate of flow of the water.

U.S. Pat. No. 3,688,775 issued to E. F. Raymann is entitled "Sunbathing And Tanning Apparatus" and discloses an air mattress having an elongated conduit mounted around the upper periphery so that water may be selectively sprinkled through apertures in the conduit onto the body of the person lying on the mattress.

U.S. Pat. No. 4,151,618 issued to A. W. Carpenter is entitled "Water Sheets". This device, as the Culligin '927 and Raymann '775 devices, provides a flexible sheet and a conduit attached to and extending along the edges of the sheet having a plurality of small openings for directing streams of water across the surface of the sheet. There are openings through the sheet to permit discharge of excess water from the surface thereof.

U.S. Pat. No. 4,625,434 issued to E. R. Kitover is entitled "Device For Sunbathing Having Water-Spray-Cooling Means" and discloses a sunbathing system in which a lounge chair having a tubular frame construction carries a number of water nozzles along the frame. The water nozzles have an outlet spray pattern to direct the fine water spray toward a person lying in the lounge chair when a water hose is operatively connected to the tubular frame.

French Pat. No. 1,209,228 entitled "Tapis de Sol a Boudin Protecteur" discloses a tarp for sunbathing having a perforated conduit about its periphery with perforations therein so that water may be selectively sprinkled through the perforations in the conduit onto the body of the person lying on the tarp.

3. General Discussion of the Present Invention

The present invention solves the prior art problems and shortcomings in a simple and inexpensive straightforward manner. The present invention provides for a sunbathing apparatus having a water spray cooling means comprising a generally rectangular flexible mat or sheet member, an elongated flexible water conduit integrally attached to a marginal side edge of the sheet member, the conduit and marginal side edge having a plurality of concentric equally spaced perforations therealong, the perforations positioned toward the upper surface of the sheet member, and means for coupling the conduit to an operative supply of water and controlling the rate of flow of the water provided the conduit whereby water flowing into the conduit and out through the perforations thereof is directed upwardly and inwardly of the marginal edge so as to direct water in a fine spray onto the upper surface of the sheet. The sheet would be of a vinyl plastic material and of a silver color so that it could be used without water. The means for controlling the rate of flow of the water would be a globe valve of hard durable plastic movable from an open position to allow a full supply of water to flow to said conduit and a second position preventing the supply of water to said conduit.

Thus, it is an object of the present invention to provide a simple and inexpensive apparatus for sunbathing having water spray cooling means.

It is another object of the present invention to provide a sunbathing apparatus having a water spray cooling means of integral plastic construction and easily connectable to a supply of water.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
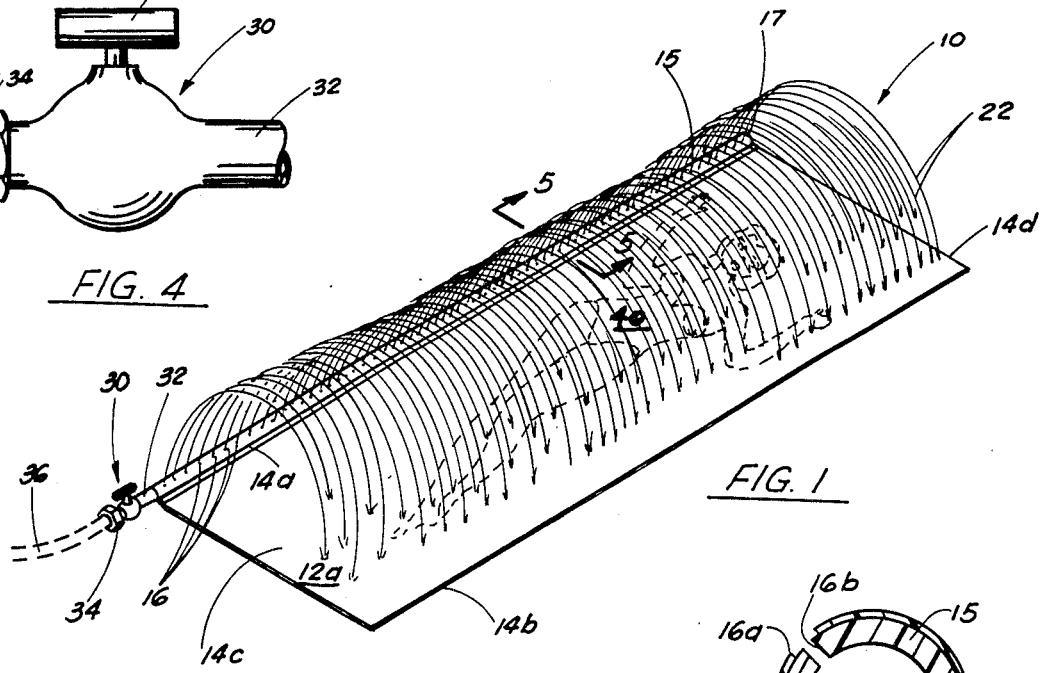
FIG. 1 is a perspective view of the preferred embodiment of the apparatus of the present invention in an operative state.
Figure 5:
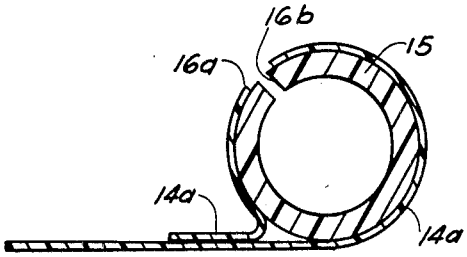
FIG. 5 is an enlarged cross-sectional view of the preferred embodiment of the apparatus of the present invention taken along line 5—5 of FIG. 1, but with the apparatus in the non-operative condition.

FIG. 1 best illustrates the preferred embodiment of the apparatus of the present invention designated generally by the numeral 10. In FIG. 1 there can be seen a flexible sheet or mat member 12 of a thin soft flexible material preferably vinyl plastic. Mat member 12 is of a generally rectangular shape defining an upper surface **12*a* and bottom or lower surface 12*b* and a plurality of edges 14 (14*a*–14*d*). In the preferred embodiment apparatus 10 would be of a length and width of seven (7') feet (2.13 m) by thirty (30") inches (0.76 m) to accommodate a wide range of individuals. One marginal side edge 14*a* of mat 12 is provided with an elongated flexible water conduit or hose member 15 around which marginal side edge 14*a* is wrapped forming a tubular channel so that sheet 12 at marginal edge 14***a* is integrally attached to conduit or hose 15 along the lengths thereof. The conduit or hose 15 may be in the form of either metal or plastic but in the preferred embodiment it is a plastic hose to more easily be integrally formed with sheet member 12 at marginal edge 14*a*. (This integral formation allows for rolling up sheet member 12 on conduit 15 for easy storage.) Conduit 15 and integral marginal side edge 14*a* of sheet 12 each have a plurality of equally spaced perforations 16 along their lengths, the perforations 16 (perforations 16*a* in conduit 15 and perforations 16*b* in marginal side edge 14*a*) being aligned radially, as best seen in FIG. 5, and being positioned in conduit 15 and marginal side edge 14*a* toward upper surface 12*a* of sheet 12 as best illustrated in FIG. 3 so that water emitted from perforations 16 will be directed upwardly and inwardly of edge 14*a* toward an individual 40 lying on upper surface 12*a* of sheet 12.

Figure 3:
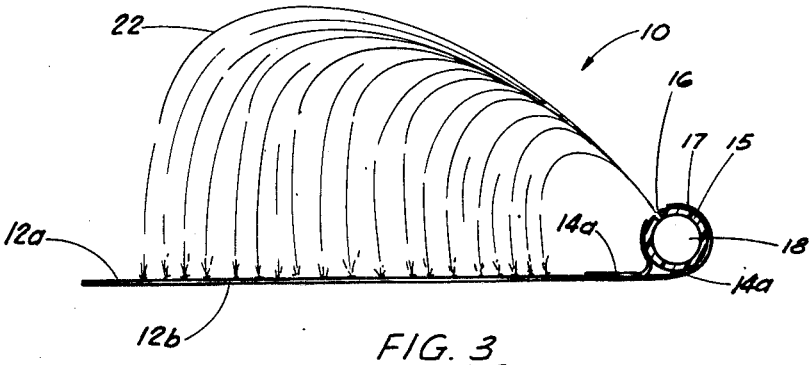
FIG. 3 is an end view, the end being the end opposite that of FIG. 2, of the apparatus of FIG. 1 in an operative state.

One end 17 of the conduit 15, best seen in FIG. 3, is plugged or sealed with plug 18. The other end of conduit 15 is integrally formed with a conventional water flow control valve or globe valve 30 via conduit section 32. At the other end of control valve or globe valve 30 is another water tight connection, such as threaded connection 34, to which a water supply hose 36, preferably an ordinary garden hose, is connected. Naturally, the opposite end of hose 36 is connected to a conventional water supply faucet, such as the outdoor faucet found in homes, parks, at beaches and elsewhere.

The marginal side edge 14*a* of sheet 12 which integrally surrounds conduit 15 is preferably of a dark color, such as black or dark green, since these colors will better absorb the heat rays of the sun. The flexible sheet 12 is preferably of a light color, such as silver, so that it will reflect the rays rather than absorb them. With this arrangement water issuing from a cold water faucet would be slightly heated as it flows through conduit 15 at a relatively slow flow rate and eventually through perforations 16 for its intended use.

Figure 4:
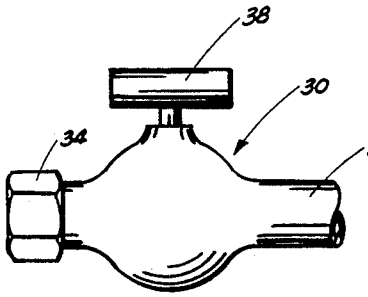
FIG. 4 is a front plan view of the globe valve of the preferred embodiment of the apparatus of the present invention.
Figure 2:
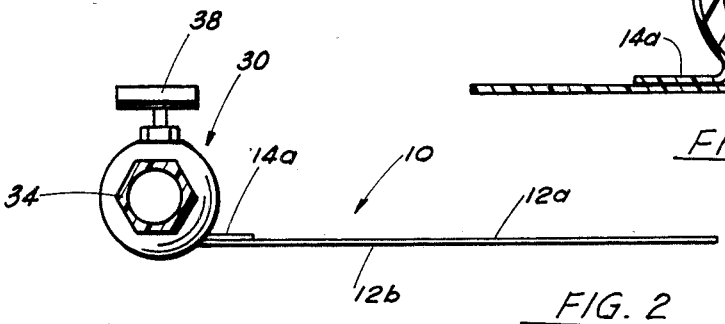
FIG. 2 is an end view of the apparatus of FIG. 2 in a nonoperative state.

In operation, water supply hose 36 is threadably attached to globe valve 30 at threaded connection 34. Handle 38 of globe valve 30 is turned from the "closed" position of FIG. 2 in which the water supply is prevented from entering conduit 15 to an "open" position of FIGS. 1, 3 and 4 where water can flow from its supply to conduit 15 and out perforations 16 and onto person 40 who has assumed the desired position on upper surface 12*a* of sheet 12. With water flowing through conduit 15 it will exit perforations 16 and be sprayed in a fine mist in a pattern 22 such as illustrated in FIGS. 1 and 3. By adjusting handle 38 to a position intermediate the open position (illustrated in FIGS. 1 and 4) and the closed position (illustrated in FIG. 2) the rate of flow of water through conduit 15 and out perforations 16 can be varied so that water pattern 22 varies from a dripping to the sprinkling effect illustrated in FIGS. 1 and 3 (FIGS. 1 and 3 showing the fully opened position of globe valve 30).

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A sunbathing apparatus having water spray cooling means comprising:

a. a generally rectangular flexible sheet member of a light reflecting material, and having a first marginal side edge of a light absorbing material, said side edge being integral with the sheet member and being of a tubular channel shape;

b. an elongated flexible water conduit integrally attached to said first marginal side edge of said sheet member, said conduit and said marginal side edge having a plurality of longitudinally spaced perforations therealong, said perforations positioned toward the upper surface of said sheet member, whereby each of said perforations in said marginal side edge of said sheet member is radially aligned with one of said perforations in said conduit; and c. means for coupling said conduit to an operative supply of water and controlling the rate of flow of water provided said conduit, whereby water flowing into said conduit and out through said perforations in said conduit and said marginal side edge of said sheet member is directed upwardly and inwardly of said marginal edge of said sheet member so as to direct a spray of water onto the upper surface of said sheet member.

2. The apparatus of claim 1 wherein said perforations are equally spaced longitudinally of said integrally attached conduit and marginal side edge of said sheet member.

3. The apparatus of claim 1 wherein said sheet member is vinyl plastic.

4. The apparatus of claim 1 wherein said coupling and controlling means includes a valve member movable from a first position allowing communication of water from said supply of water to said conduit to a second position preventing the flow of water from said supply to said conduit.

* * * * *